US006751818B2

(12) United States Patent
Troop

(10) Patent No.: US 6,751,818 B2
(45) Date of Patent: Jun. 22, 2004

(54) AIRWAY MANAGEMENT APPARATUS AND METHOD

(76) Inventor: Craig Troop, 4701 Augusta Dr., Frisco, TX (US) 75034-6839

( * ) Notice: Subject to any disclaimer, the term of this patent is extended or adjusted under 35 U.S.C. 154(b) by 0 days.

(21) Appl. No.: 10/072,162

(22) Filed: Feb. 7, 2002

(65) Prior Publication Data

US 2002/0112289 A1 Aug. 22, 2002

Related U.S. Application Data

(60) Provisional application No. 60/269,318, filed on Feb. 16, 2001.

(51) Int. Cl.[7] ..... A47G 9/00
(52) U.S. Cl. ..... 5/636; 5/630
(58) Field of Search ..... 5/636, 632, 630, 5/644, 638

(56) References Cited

U.S. PATENT DOCUMENTS

| | | | | | |
|---|---|---|---|---|---|
| 1,349,072 | A | | 8/1920 | Lines | |
| 2,199,479 | A | | 5/1940 | Cappel | |
| 3,389,411 | A | | 6/1968 | Emery | |
| 3,648,308 | A | | 3/1972 | Greenawalt | |
| 4,193,150 | A | | 3/1980 | Vineberg | |
| 4,424,599 | A | * | 1/1984 | Hannouche | 5/636 |
| 4,771,493 | A | | 9/1988 | Park | 5/437 |
| 4,805,603 | A | * | 2/1989 | Cumberland | 5/632 |
| 5,048,136 | A | * | 9/1991 | Popitz | 5/636 |
| 5,123,132 | A | | 6/1992 | Dixon | 5/636 |
| 5,184,365 | A | * | 2/1993 | Stafford | 5/644 |
| 5,581,831 | A | * | 12/1996 | Xiang | 5/636 |
| D384,850 | S | | 10/1997 | Fannuzzi | D6/601 |
| 5,697,112 | A | | 12/1997 | Colavito et al. | 5/633 |
| D391,371 | S | | 2/1998 | Coakley | D24/164 |
| 5,713,384 | A | * | 2/1998 | Graham | 5/632 |
| D407,259 | S | | 3/1999 | Jackson | D6/604 |
| 6,000,401 | A | | 12/1999 | Herrick | 128/869 |
| 6,079,409 | A | | 6/2000 | Brain | 128/200.26 |
| 6,189,533 | B1 | | 2/2001 | Simon et al. | 128/207.14 |
| 6,251,069 | B1 | | 6/2001 | Mentzelopoulos et al. | 600/196 |
| 6,257,236 | B1 | | 7/2001 | Dutkiewicz | 128/207.14 |
| 6,446,288 | B1 | * | 9/2002 | Pi | 5/636 |

* cited by examiner

*Primary Examiner*—Alexander Grosz
(74) *Attorney, Agent, or Firm*—Michael L. Diaz

(57) ABSTRACT

An Airway Management Apparatus (AMA) and method for easing the breathing and aiding the alignment of the oral, pharyngeal, and laryngeal axes of the airway of an obese individual in the supine position. The AMA includes an upper-body support, and a head and neck support having a partially concave and partially convex surface coupled to the upper-body support. The AMA eases breathing by raising the individual's upper body at an angle, causing the individual's abdominal mass to fall away from the diaphragm. The AMA provides a support for the individual's neck to be extended, and for the head to be rotated backwards, to aid in the alignment of the oral, pharyngeal, and laryngeal axes of the individual's airway.

15 Claims, 4 Drawing Sheets

AIRWAY MANAGEMENT APPARATUS AND METHOD

PRIORITY UNDER 35 U.S.C. §119(e) & 37 C.F.R. §1.78

This nonprovisional application claims priority based upon the prior filed U.S. provisional patent application Ser. No. 60/269,318, entitled "Upper Body Support and Intubation Pillow," filed Feb. 16, 2001, in the name of Craig Troop, which is hereby incorporated by reference for all purposes.

BACKGROUND OF THE INVENTION

1. Technical Field of the Invention

The present invention relates to medical devices and, in particular, to an Airway Management Apparatus for easing the breathing and aiding the alignment of the oral, pharyngeal, and laryngeal axes of an airway of an obese individual in the supine position.

2. Description of Related Art

Airway management concerns the ability to maintain open air passages in an individual, especially during surgical operations where anesthesia is administered to alter the state of consciousness and stabilize body functions. During such operations, the ability of the body to maintain an adequate airway may be compromised, and external airway management procedures must be undertaken to ensure the breathing airway remains open and unobstructed.

Endotracheal intubation, a medical procedure that secures an individual's airway through placement of a breathing tube in the individual's trachea in order to facilitate either spontaneous or controlled gas exchange, is routinely carried out in operating rooms after the induction of anesthesia or in emergencies to establish and maintain an adequate airway. The endotracheal intubation process requires an unobstructed airway that is obtained by aligning the oral, pharyngeal, and laryngeal axes in the body. This process is usually achieved without great difficulty under direct vision provided by an instrument such as a laryngoscope that exposes the individual's vocal cords.

More specifically, an endotracheal intubation is usually performed using a laryngoscope having a rigid straight blade (known as a Miller type blade), or a rigid curved blade (known as a Macintosh type blade) on a supine and anaesthetized individual. During the endotracheal intubation and prior to the individual being connected to a breathing machine, the individual's breathing is mechanically assisted by a physician or other health professional physically moving air into the individual's lungs with a ventilation bag.

The most commonly used technique in an endotracheal intubation consists of extending the individual's neck and rotating the head backwards in order to achieve alignment of the individual's oral, pharyngeal, and laryngeal axes. Typically, in normal sized individuals, that is an individual having a proper height to weight ratio, the alignment of the oral, pharyngeal, and laryngeal axes is aided by placing a standard pillow or small foam pillow under the individual's head and neck. Next, the individuals's mouth is opened and the laryngoscope is introduced into the mouth. Then, the individual's vocal cords are exposed allowing the endotracheal tube to be inserted through the exposed vocal cords. The tip of the endotracheal tube includes an inflatable collar that is inflated to create a seal on the inside of the trachea. The exterior end of the tube is connected to a breathing machine that sustains the individual's breathing while under the anesthesia.

Once the breathing tube is in place, a surgical procedure may be conducted on the anaesthetized individual. Following the surgical procedure, the individual is gradually brought out of the anesthesia. At that time, the breathing machine is disconnected, the endotracheal breathing tube is removed, and the individual begins breathing on his own.

It has been found, however, that performing an endotracheal intubation on an obese individual is more difficult. During the endotracheal intubation, the physician attempts to align the oral, pharyngeal and laryngeal axes so that the endotracheal tube can be visually guided into the proper position. At the same time, the physician mechanically assists the obese individual's breathing by physically moving air into the obese individual's lungs with a ventilation bag. When working with an obese individual positioned on a standard pillow, the physician is at a mechanical disadvantage due to the abdominal mass of the individual pressing upward against the individual's diaphragm. To ventilate the supine individual, the physician must exert enough force for the air pressure to move the individual's diaphragm against the weight of the individual's abdominal mass. In a normal sized individual, this mass may be easily displaced. In an obese individual, however, the large abdominal mass may be difficult for the physician to displace. Standard prior art pillows do not alleviate this problem.

Moreover, a similar problem occurs following the surgical procedure when the obese individual is brought out of anesthesia and must begin breathing on his own. The obese individual must breathe with enough force to displace his abdominal mass with his diaphragm. Since the individual is still somewhat anaesthetized, it may be difficult for attending personnel to get the individual to breathe with enough force. Standard pillows do not help with this problem.

The magnitude of the problem of managing the airways of obese individuals may be more fully appreciated in view of statistics that indicate that approximately 60% of adults in the United States today qualify as obese. Therefore, a need has arisen for an airway management apparatus that is capable of easing the breathing of obese individuals in the supine position. A need has also arisen for an airway management apparatus that aids in the alignment of the oral, pharyngeal and laryngeal axes in obese individuals.

SUMMARY OF THE INVENTION

The present invention disclosed herein comprises an Airway Management Apparatus (AMA) and method that are capable of easing the breathing of obese individuals in the supine position. Additionally, the AMA aids the alignment of the oral, pharyngeal, and laryngeal axes of the airway of these individuals. The AMA achieves these results by providing a head and neck support that is operable to provide support to an individual's head and neck while the individual is in the supine position. The invention raises the individual's chest cavity, causing the individual's abdominal mass to fall away from the chest and diaphragm, thereby easing breathing. Moreover, the AMA positions the individual's head so that the head may be more easily rotated backwards and positions the individual's neck so that the neck may be more easily extended, thereby aiding the alignment of the oral, pharyngeal, and laryngeal axes of the airway.

Thus, in one aspect, the present invention is directed to an AMA which includes a head and neck support. The head and neck support includes an upper surface that contacts the head and neck and raises the head and neck above a base surface. An upper-body support is coupled to the head and neck support and supports the individual's upper body at an angle sufficient to cause the individual's abdominal mass to fall away from the diaphragm. The upper-body support has a substantially planar top surface that slopes downward from the upper surface of the head and neck support to the base surface.

The head and neck support may include a transverse cylindrical support piece for supporting the individual's neck, and a substantially planar or concave horizontal support piece for supporting the individual's head. The AMA may be integrally formed from an elastomeric material such as a foam polyurethane material.

In another aspect, the present invention is directed to an AMA which includes a means for elevating the head and upper body of the individual above a base surface on which the individual is positioned. Additionally, a means is coupled to the elevating means for providing vertical support under the individual's neck at a height above the individual's shoulders. Furthermore, a means is coupled to the elevating means and the neck supporting means for supporting the individual's head at a height approximately equal to or lower than the individual's neck. Thus by raising the individual's upper airway, the individual's head may be rotated backwards and neck extended to aid the alignment of the oral, pharyngeal, and laryngeal axes of the airway. Additionally, a means for supporting the individual's back may be included. A means for supporting the lower lumbar region and a means for providing additional comfort may also be included.

In yet another aspect, the present invention is directed to a method of reducing the amount of positive air pressure that attending personnel must maintain in a supine obese individual's lungs to move the individual's diaphragm. The method includes the steps of raising the individual's head and neck above the base surface and supporting the individual's upper body at an angle sufficient to cause the individual's abdominal mass to fall away from the diaphragm, thereby reducing the amount of air pressure required in the obese individual's lungs to move the individual's diaphragm.

In yet another aspect, the present invention is directed to a method of inserting an endotracheal breathing tube into the trachea of an obese individual lying in an approximately supine position on a base surface.

The method includes the steps of reducing the amount of air/airway pressure required in the obese individual's lungs to move the individual's diaphragm, ventilating the individual (under anaesthesia), aligning the oral, pharyngeal, and laryngeal axes of the individual to enable visual acquisition of the trachea, and inserting the endotracheal tube into the trachea. The step of reducing the amount of pressure required to move the individual's diaphragm may be performed by raising the individual's head and neck approximately six inches above the base surface, and supporting the individual's upper body at an angle sufficient to cause the individual's abdominal mass to fall away from the diaphragm. The step of aligning the various airway axes may be performed by extending the individual's neck over a neck support and extending the individual's neck and head backward on a head support.

It should be noted that, the AMA and method of the present invention may also be used to treat sleep apnea, gastro esophageal reflux and breathing problems associated with pregnancy.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
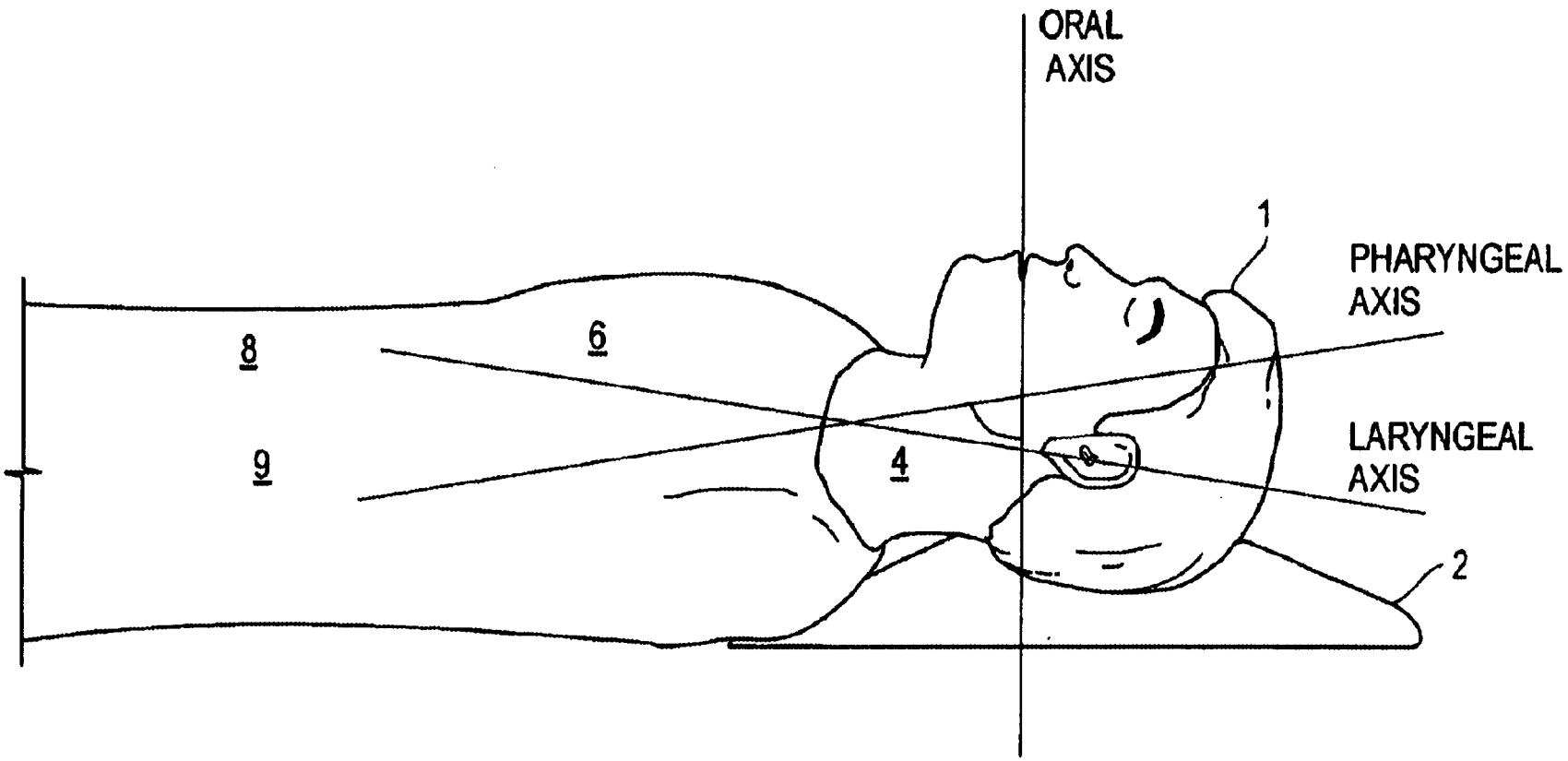
FIG. 1 (Prior Art)
FIG. 1 (Prior Art) is a side view of an obese individual in the supine position on a standard sleeping pillow wherein the standard sleeping pillow does not ease the breathing of the obese individual or aid the alignment of the oral, pharyngeal, and laryngeal axes.

Preferred embodiments of the invention are described below with reference to various examples of how the invention can best be made and used. Like reference numerals are used throughout the description and several views of the drawings to indicate like or corresponding parts.

Referring now to FIG. 1 (Prior Art), an obese individual 1 is illustrated on a prior art pillow 2. The airway management of the obese individual 1 on the prior art pillow 2 is difficult. More specifically, during an endotracheal intubation, the prior art pillow 2 does not aid the alignment of the oral, pharyngeal, and laryngeal axes of the airway of the obese individual 1. With the axes of airway grossly misaligned, a physician will have difficulty inserting a laryngoscope and may have to lean over the obese individual 1 excessively to access the upper airway 4. Moreover, the upper airway 4 of the obese individual is in the same plane as the chest 6 and the abdominal area 8. This places a physician hand-ventilating an obese individual at a mechanical disadvantage. The physician must exert enough force for the resulting airway pressure to move the individual's diaphragm 9 against the weight of the abdominal mass 8. Similarly, an obese individual, to breathe on his own, must exert enough force to move his diaphragm 9 against the weight of his abdominal mass 8.

Figure 2:
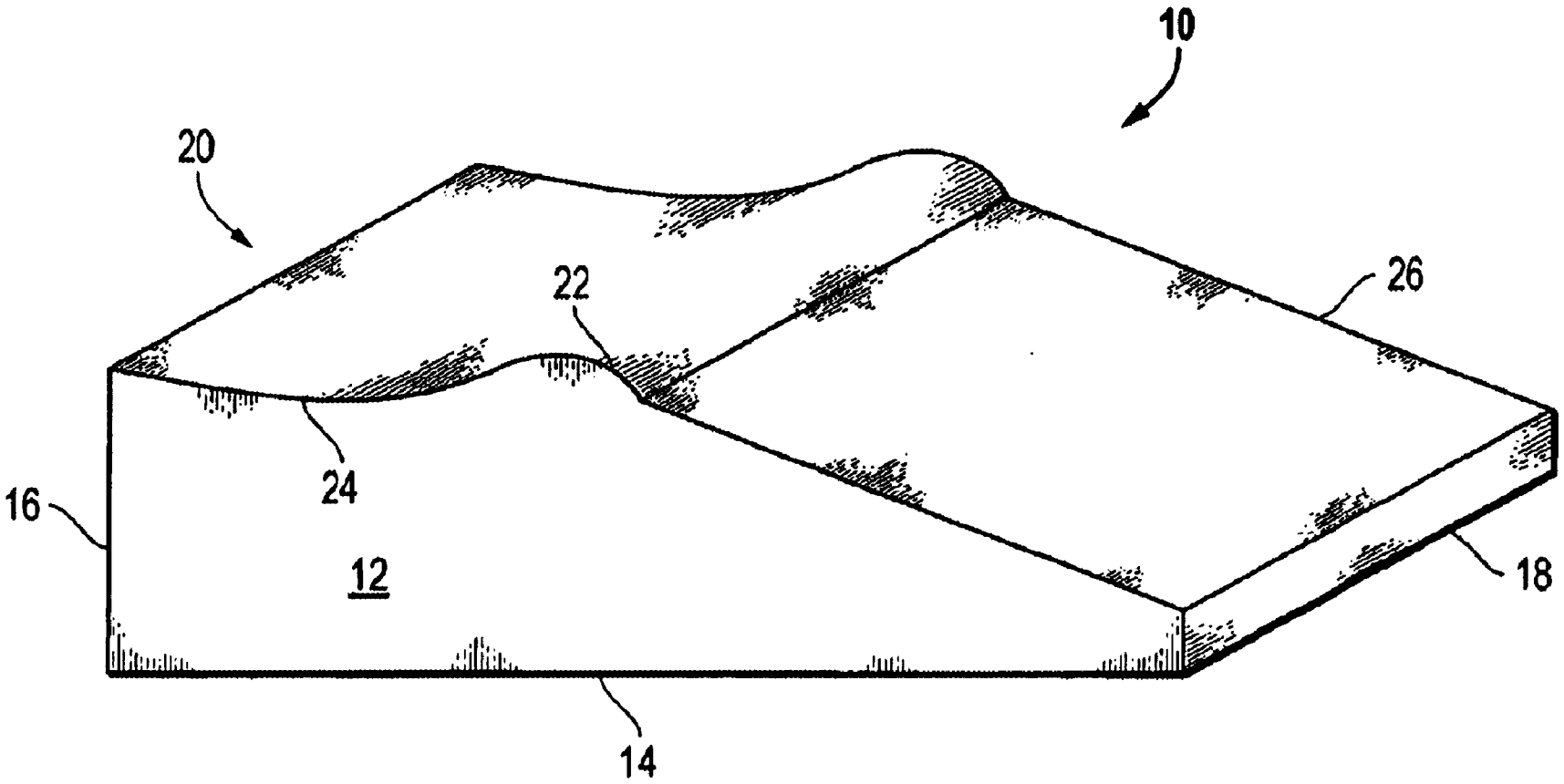
FIG. 2 is a perspective view of the Airway Management Apparatus (AMA) of the present invention for easing the breathing and aiding the alignment of the oral, pharyngeal, and laryngeal axes of the airway of an obese individual in the supine position.

Referring to FIG. 2, an Airway Management Apparatus (AMA) of the present invention for easing the breathing and aiding the alignment of the oral, pharyngeal, and laryngeal axes of the human body of an obese individual in the supine position is illustrated and generally designated 10. The AMA 10 includes a base 12 having a substantially planar surface 14 and ends 16 and 18. A planar surface 14 allows AMA 10 to be positioned on a bed or operating table or any other substantially planar surface. The AMA 10 includes a head and neck support 20 coupled to base 12.

The head and neck support 20 includes an upper support 22 and a lower support 24. The upper support 22 has a convex surface that protrudes from the head and neck support 20 to operably provide support to the neck and a portion of the head of an individual (not shown). Preferably, the upper support of the head and neck support has a cylindrical shape to provide a gently contoured transition between the neck and shoulders of the obese individual.

The lower support 24 is positioned to operably provide support to the posterior portion of the obese individual's head. The surface of the lower support 22 may be substantially planar or slightly concave to support the obese individual's head.

An upper-body support 26 is coupled to the base 12, the head and neck support 20 and the end 18. Preferably, the surface of the upper-body support 26 is substantially planar. Preferably, the upper-body support forms an angle between about 0° and about 60° with the horizontal. More preferably, the upper-body support forms an angle between about 50 and about 200 with the horizontal. The upper-body support is positioned to operably provide support to the shoulders and back of an individual.

AMA 10 preferably comprises a structural plastic foam such as a foam polyurethane material, urethane foam, or other elastomeric material. The foam used may consist of a variety of colors and may comprise a variety of different densities that determine the hardness or softness of the AMA 10. Further, the material may possess anti-static properties.

More specifically, indentation Force Deflection (IFD) measures the firmness of a piece of foam. The test involves placing a 4"×15"×15" piece of foam on a flat surface. A round metal plate, 8" in diameter, pushes down on the piece of foam. The amount of pounds of pressure required to squeeze the piece of foam from 4" to 3" is the IFD. Preferably, the AMA 10 of the present invention has an IFD of between about 22 to about 42.

Additionally, the State of California Bureau of Home Furnishings Technical Bulletin #117 (Bulletin #117) requires that all foam sold in retail in the state of California must pass a fire retardant test. The test involves exposing a piece of foam to an open flame until the foam is burning. Once the foam is burning, the foam is removed from the flame. Fire retardant foam ceases to burn once removed from the flame. Preferably, since California is such a large consumer of foam, the AMA 10 meets Bulletin #117 requirements.

It should be apparent to one skilled in the art that the AMA 10 may comprise a variety of elastomeric materials. For example, a white J32 foam type having a density of 0.90–0.95 and an IFD of 29.0–36.0 may be employed. Alternatively, a blue I32XB foam type having a density of 1.20–1.26 and an IFD of 32.0–37.0 that exceeds California Bulletin #117 flammability requirements may be employed. Alternatively, a pink P25T foam type having a density of 1.20–1.26, an IFD of 24.0–29.0 and anti-static properties may be employed.

Preferably, the structural plastic foam is manufactured from a low pressure injection mold process. However, the molding can be manufactured by any conventional polymer fabrication method. For example, the fabrication method may involve compression molding using heat and pressure to force the molten polymer or resin, introduced between the mating surfaces of a movable mold, into the shape of the mold. In another embodiment, the fabrication method can be comprised of injection molding where a molten polymer is compressed into a closed mold cavity. Other fabrication methods include reaction injection molding and extrusion filament spinning.

Preferably, the AMA 10 is constructed as an integral piece of moldable material. However, it should be apparent to one skilled in the art that the AMA may be constructed of several pieces that are assembled into one piece by any hereto known or unknown method. For example, the pieces may be affixed to one another by an adhesive such as an epoxy or glue.

In the preferred embodiment of the present invention, the AMA 10 may be about 30 inches long. The head and neck support 20 may extend about 20 inches wide and about 11 inches long. The head and neck support 20 may have a height of about 5 to 8 inches at the lower support member 24. The individual's neck is supported by the upper support 22, which may be about 5 to 9 inches high and may have a radius of curvature of approximately 1 inch. The upper-body support 26 may slope down from about 6 inches in height at the head and neck support 20 to about 2 inches in height at the end 18. The upper body support 26 may have a length of about 8–20 inches. The components of the AMA 10 are designed to engage the head, neck, shoulders and back of an obese individual of any height and of any weight. AMA 10 may even accommodate morbidly obese individuals weighing in excess of 500 lbs.

Figure 3:
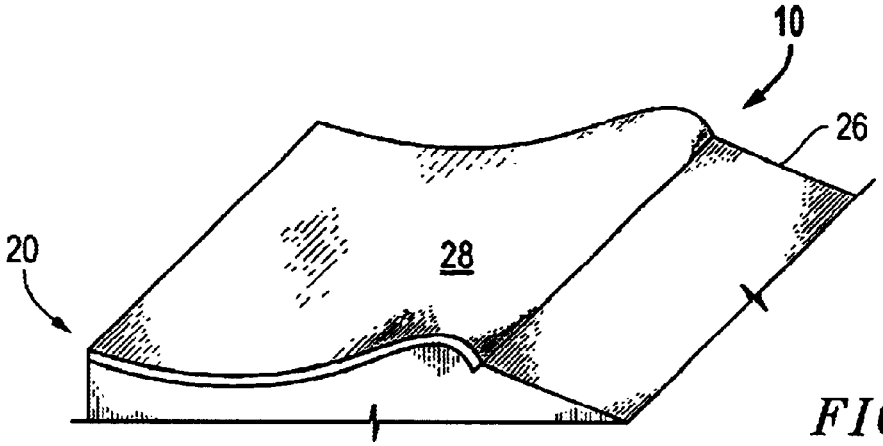
FIG. 3 is a partial perspective view of an alternate embodiment of the present invention employing a comfort layer.

Referring now to FIG. 3, an alternate embodiment of the AMA of the present invention is illustrated. This embodiment is similar to the embodiment shown in FIG. 1, but with the addition of a comfort layer 28. The comfort layer 28 is disposed on the surface of the head and neck support 20 of AMA 10 to provide a physically soft and comfortable layer. Preferably, the comfort layer is a ½ inch layer of memory foam. As illustrated, the comfort layer 28 is only disposed on the surface of the head and neck support 20. However, it should be understood by one skilled in the art that the comfort layer 28 could be disposed on any surface on the AMA 10.

Figure 4:
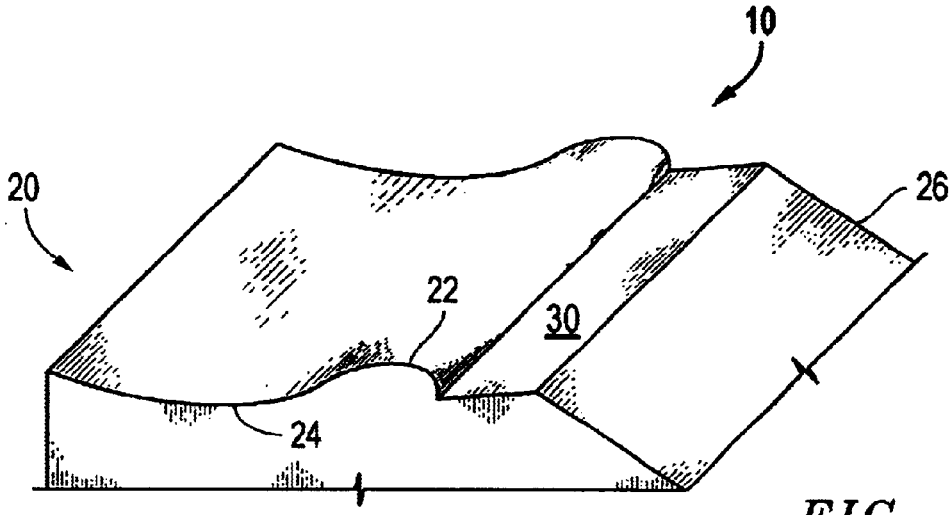
FIG. 4 is a partial perspective view of another alternate embodiment of the present invention employing a shoulder support.

Referring now to FIG. 4, another embodiment of the AMA of the present invention is illustrated. This embodiment is similar to the embodiment shown in FIG. 1, but with the addition of a shoulder support 30. The shoulder support 30 is coupled to the upper-body support 26 to provide additional support and comfort to the obese individual's shoulders. Preferably, the shoulder support 30 may be about 6 inches in height and about 4 inches in length.

Figure 5:
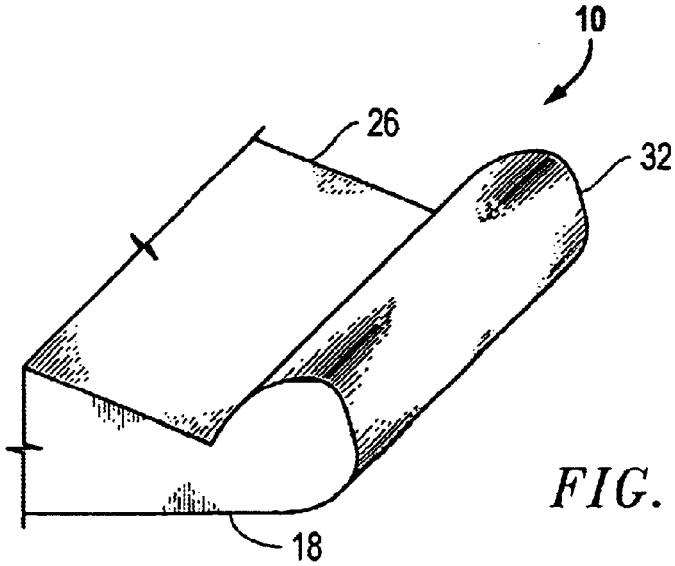
FIG. 5 is a partial perspective view of yet another alternative embodiment of the present invention employing a lumbar support.

Referring to FIG. 5, yet another embodiment of the AMA of the present is illustrated. In this embodiment, a lumbar support 32 is positioned on the end 18 to provide lower back support to the obese individual. The lumbar support 32 comforts the lumbar spine lordosis and helps to prevent the supine individual's body from shifting. Preferably, the lumbar support 32 may take the form of a cylinder approximately 5 inches in diameter.

Figure 6:
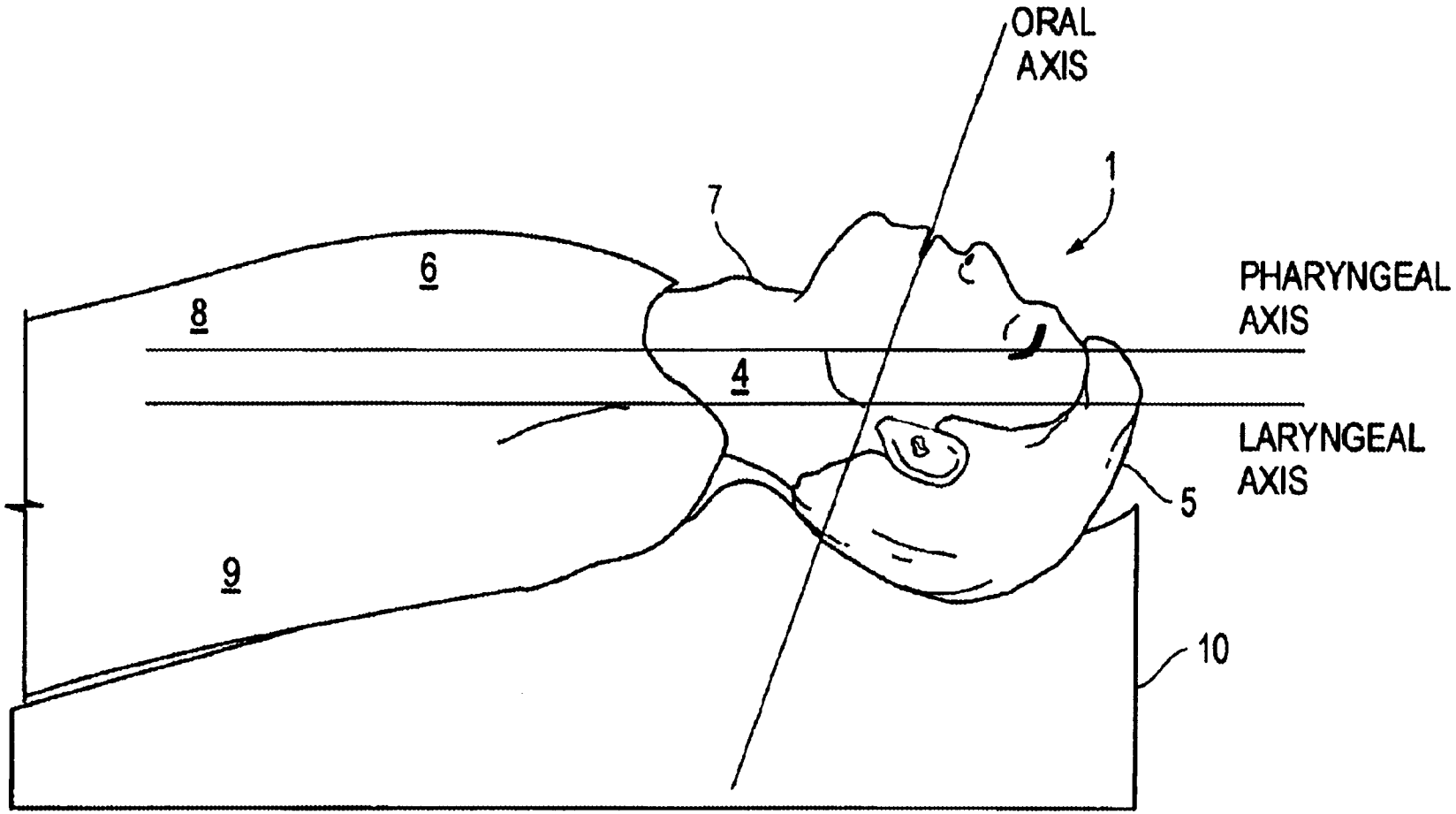
FIG. 6 is a side view of an obese individual in the supine position on the AMA of the present invention wherein breathing is eased and the alignment of the oral, pharyngeal, and laryngeal axes is aided.

Referring now to FIG. 6, an obese individual 1 is illustrated in the supine position on the AMA 10 of the present invention. The AMA eases the obese individual's breathing and assists in the alignment of the oral, pharyngeal and laryngeal axes.

The AMA eases breathing by raising the individual's head 5 and neck 7 above the base surface, and supporting the individual's chest 6 at an angle sufficient to cause the obese individual's abdominal mass 8 and its contents to "fall away" from the chest 6 and in particular the obese individual's diaphragm 9. With the weight of the abdominal mass 8 and its contents removed from the diaphragm 9, the obese individual is more easily able to move the diaphragm and is therefore able to breathe easier. Similarly, a physician may more easily ventilate the obese individual since less positive air pressure will be required in the individual's lungs to move the individual's diaphragm 9 against the weight of the abdominal mass 8.

The AMA 10 aids the alignment of the oral, pharyngeal, and laryngeal axes by providing a surface that raises the head 5 and neck 7 above the chest 6 and shoulders. This causes the head 5 to rotate backwards and the neck 7 to extend. As a result, the AMA aids the alignment of the axes of the airway in obese individuals, whereas prior art pillows do not. As best seen in FIG. 6, the pharyngeal and laryngeal axes are in near alignment and the oral axis is between 40° and 60° from alignment. It should be understood that the degree of alignment in FIG. 6 has been presented by way of example and not by way of limitation. It should be appreciated by one skilled in the art that the degree of alignment provided by the AMA will vary between obese individuals.

During an endotracheal intubation, a physician employing the AMA of the present invention may position himself close enough to the head 5 of the obese individual that he is able to access the upper airway 4 at the midrange of his elbow movement. The physician does not have to lean over the obese individual excessively to access upper airway 4 as with prior art pillows. Additionally, the physician may visibly access the trachea by rotating the head backwards and extending the neck. Furthermore, the physician may easily ventilate an anaesthetized individual if need be since the amount of air pressure required to move the diaphragm is reduced by employing the AMA as described above. Therefore, the physician employing the AMA may more quickly and efficiently insert the endotracheal tube during the intubation procedure.

Additionally, the AMA of the present invention assists the breathing of obese and non-obese individuals who suffer from sleeping disorders when they are in the supine position. As discussed, by employing an upper-body support that slopes downward from the head and neck support to the back surface, the present invention causes the individual's abdominal mass and its contents to "fall away" from the diaphragm. The result is improved diaphragmatic movement and greater ease in breathing.

Similarly, the present invention can be utilized to assist the breathing of pregnant women lying in the supine position. Pregnant women have a similar body type to obese individuals and suffer from some of the same breathing problems experienced by obese individuals. The AMA causes the pregnant women's abdominal mass to fall away from the diaphragm, resulting in improved diaphragmatic movement and greater ease in breathing.

Similarly, the AMA of the present invention relieves the discomfort of gastro esophageal reflux by creating a more acute angle between the esophagus and the stomach. The AMA elevates the individual's upper body to decrease gastro esophageal reflux and attendant symptoms, such as heartburn.

Further, numerous individuals with primary gastrointestinal disease benefit by using the AMA. In addition, individuals with cardio-respiratory diseases can benefit by the use of the AMA. Many of these individuals, especially individuals suffering from congestive heart failure, require elevation of the upper body, head, and neck to improve breathing and afford a more restful sleep.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. An Airway Management Apparatus (AMA) for aiding in aligning an obese individual's oral, pharyngeal, and laryngeal axes by reducing an amount of force required to move an obese individual's diaphragm when the individual is placed on top of the AMA in an approximately supine position, said AMA comprising:

a head and neck support for raising the individual's head and neck above a base surface, said head and neck support having an upper surface that contacts the back of the individual's head and neck, said head and neck support having a height between approximately five inches and eight inches; and an upper-body support coupled to the bead and neck support, said upper-body support having a substantially planar top surface that slopes downward from the upper surface of the head and neck support to the base surface, said upper-body support having a height between approximately two inches and six inches and forming an angle between approximately five and twenty-five degrees from horizontal, said upper-body support supporting the individual's upper body at an angle;

wherein the AMA aids the alignment of the oral, pharyngeal, and laryngeal axes by raising the individual's head and neck, and supports the upper body at an angle sufficient to cause the individual's abdominal mass to fall away from the diaphragm, thereby reducing the amount of force required to move the individual's diaphragm.

2. The AMA of claim 1 wherein the head and neck support includes a transverse cylindrical support piece for supporting the individual's neck.

3. The AMA of claim 2 wherein the head and neck support includes a substantially planar, horizontal support piece adjacent to the transverse cylindrical support piece for supporting the individual's head.

4. The AMA of claim 2 wherein the head and neck support includes a slightly concave, essentially horizontal support piece adjacent to the transverse cylindrical support piece for supporting the individual's head.

5. The AMA of claim 1, wherein the head and neck support and the upper-body support are integrally formed from an elastomeric material.

6. The AMA of claim 5, wherein the clastomeric material is a foam polyurethane material.

7. The AMA of claim 6, wherein the foam polyurethane material has an indentation force deflection measurement of about 22 to 42.

8. The AMA of claim 7, further comprising a comfort layer disposed on the upper surface of the head and neck support that provides physical comfort to the individual's head and neck.

9. The AMA of claim 1, further comprising a substantially planar, horizontal shoulder support piece between the head and neck support and the upper-body support that is operably positioned to support the individual's shoulders.

10. The AMA of claim 1, further comprising a lumbar support piece coupled to the upper-body support at an end opposite the head and neck support, said lumbar support comprising a transverse cylindrical support piece supporting the individual's lower back.

11. An Airway Management Apparatus (AMA) for aiding in aligning an obese individual's oral, pharyngeal, and laryngeal axes while said individual is lying on a base surface in an approximately supine position, said AMA comprising:

means for elevating the individual's upper body above the base surface sufficiently to cause the individual's abdominal mass to fall away from the diaphragm, said means for elevating the individual's upper body having a height between approximately two inches and six inches and forming an angle between five degrees and twenty-five degrees from horizontal, thereby reducing the amount of farce required to move the individual's diaphragm;

means attached to the elevating means for providing support under the individual's neck at a height above the individual's shoulder's, said means for providing support under the individual's neck having a height between approximately five inches and eight inches; and means attached to the neck support means opposite the elevating means for supporting the individual's head at a height approximately equal to or lower than the individual's neck, thereby aiding in aligning the oral, pharyngeal, and laryngeal axes.

12. The AMA of claim 11, further comprising means attached to the elevating means opposite the neck support means for supporting the individual's lumbar region.

13. The AMA of claim 11, further comprising means attached to a top surface of the head support means for providing comfort to the individual's head.

14. The AMA of claim 11, wherein the means for providing vertical support under the individual's neck is constructed of an elastomeric material that is deformable to allow the individual's neck to extend, thereby aiding in aligning the oral, pharyngeal, and laryngeal axes.

15. The AMA of claim 11, wherein the means for supporting the individual's head is constructed of an elastomeric material that is deformable to allow the individual's head to extend, thereby aiding in aligning the oral, pharyngeal, and laryngeal axes.

* * * * *